US006338180B1

(12) United States Patent
Massard

(10) Patent No.: US 6,338,180 B1
(45) Date of Patent: Jan. 15, 2002

(54) ASSEMBLABLE HANDLE FOR DOUBLE STRAP BAG

(75) Inventor: Gilles Massard, Monistrol sur Loire (FR)

(73) Assignee: Janisset SA, sur Loire (FR)

( * ) Notice: Subject to any disclaimer, the term of this patent is extended or adjusted under 35 U.S.C. 154(b) by 0 days.

(21) Appl. No.: 09/197,420

(22) Filed: Nov. 23, 1998

(30) Foreign Application Priority Data

May 15, 1998 (FR) ..... 98 06437

(51) Int. Cl.[7] ..... B65D 71/00

(52) U.S. Cl. ..... 16/114.1; 16/110.1; 190/115; 190/117; 383/15; 383/17; 383/20

(58) Field of Search ..... 16/125, 122, 199, 16/126, 114.1, 110 R, 110.5, 116, DIG. 12, DIG. 18, DIG. 24, DIG. 25; 190/118, 119, 115, 116, 117; 383/20, 7, 15, 17; D3/232, 243, 246; 220/755; 206/315.1, 579

(56) References Cited

U.S. PATENT DOCUMENTS

| | | | | | |
|---|---|---|---|---|---|
| 1,359,461 | A | * | 11/1920 | Luce | 16/119 |
| 1,658,174 | A | | 2/1928 | Russell | |
| 2,448,384 | A | * | 8/1948 | Meinzinger | 16/111 R |
| 2,488,309 | A | | 11/1949 | Mason | |
| RE23,629 | E | | 3/1953 | Henriksen | |
| 2,800,940 | A | | 7/1957 | Riesebeck | |
| 3,115,228 | A | | 12/1963 | Louik et al. | |
| 3,115,229 | A | | 12/1963 | Erhard | |
| 3,486,684 | A | | 12/1969 | Dills et al. | |
| 3,737,945 | A | | 6/1973 | Gould | |
| 3,784,084 | A | * | 1/1974 | Pearl | 229/54 R |
| 3,944,033 | A | | 3/1976 | Simson | |
| 4,207,997 | A | * | 6/1980 | Croyle | 224/55 |
| 4,316,629 | A | | 2/1982 | Jacoby | |
| 4,387,846 | A | | 6/1983 | DuCorday | |
| 4,592,091 | A | | 5/1986 | Italici | |
| 4,792,983 | A | | 12/1988 | Allegre | |
| 4,799,521 | A | * | 1/1989 | Shick | 190/115 |
| 5,210,904 | A | | 5/1993 | Pratt | |
| 5,339,517 | A | * | 8/1994 | Diener | 29/809 |
| 5,670,274 | A | | 9/1997 | Forrer | |
| 5,813,092 | A | * | 9/1998 | Greenfield et al. | 16/110 R |
| 6,049,945 | A | * | 4/2000 | Prevot et al. | 16/110.1 |

FOREIGN PATENT DOCUMENTS

| | | | |
|---|---|---|---|
| FR | 374384 | A | 6/1907 |
| FR | 1076388 | A | 10/1954 |
| GB | 1134548 | A | 11/1968 |

* cited by examiner

*Primary Examiner*—Lynne H. Browne
*Assistant Examiner*—Mark Williams
(74) *Attorney, Agent, or Firm*—Oliff & Berridge, PLC.

(57) ABSTRACT

An assemblable handle includes two elements made of synthetic material, each element connected to a strap that forms a loop. A male element has the general shape of an inverted "T" in cross section and includes a sole and a lengthwise rib. A female element has the general shape of an inverted "U" in cross section with an inside cavity capable of fitting elastically onto the lengthwise rib of the male element.

20 Claims, 4 Drawing Sheets

ASSEMBLABLE HANDLE FOR DOUBLE STRAP BAG

BACKGROUND OF THE INVENTION

1. Field of Invention

The invention relates to double strap bags, for example roll bags made of a tubular pouch.

2. Description of Related Art

In double strap bags, it is already known that the two straps can be joined by a removable band located in the gripping area of the straps to prevent this area from hurting the carrier's hand when the bag is heavily loaded. The band also has the advantage of facilitating gripping of the straps when the bag has been set down since, by bringing them together, it prevents them from dropping to either side of the bag. However, due to its removability, the band may go astray.

SUMMARY OF THE INVENTION

A goal of the present invention is to provide an assemblable handle that remains integral with the straps while improving contact with the hand, particularly when the bag is heavily loaded.

This assemblable handle is composed of two elements made of synthetic material, each handle fixed onto, preferably overmolded on, a strap. Namely the handle includes a male element whose cross section has the general shape of an inverted "T," composed of a sole and a lengthwise rib, and a female element whose cross section has the general shape of an inverted "U", whose inside cavity is able to fit elastically over the lengthwise rib of the male element.

Thus, each strap is integral with the corresponding handle element, and when the bag is carried, one need only fit the lengthwise rib of the male element into the inside cavity of the female element to form a rigid handle that improves the grip of the loops and the comfort of the hand.

In some embodiments, the male element is made of a synthetic material that differs from that of which the female element is made by a lower Shore hardness and a higher coefficient of friction.

This arrangement confers some softness on the lower part that comes in contact with the hand that carries the load, but also improves the grip so that, for example if the handle becomes dampened by rain, the hand will not slip on the handle.

Other characteristics and advantages will emerge from the description hereinbelow with reference to the attached schematic drawings which show exemplary embodiments of handles of the invention in the application case of a roll bag.

BRIEF DESCRIPTION OF THE DRAWINGS

Embodiments of this invention will be described in detail, with reference to the following drawings, wherein like numerals represent like elements and wherein.

DETAILED DESCRIPTION OF PREFERRED EMBODIMENTS

Figure 1:
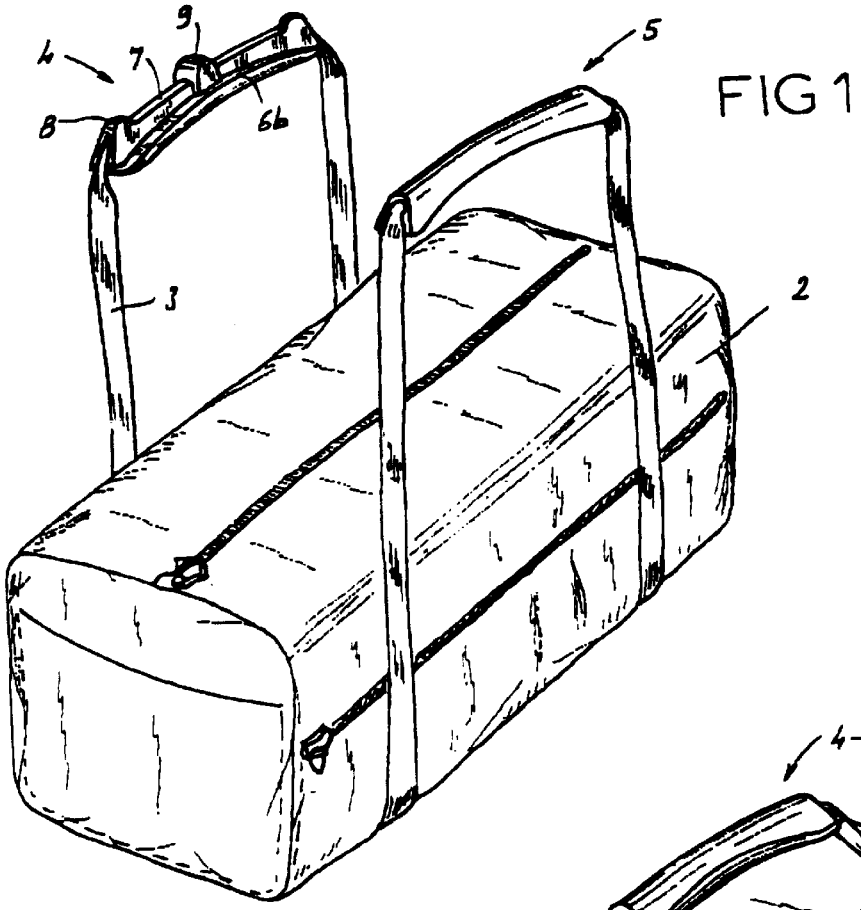
FIGS. 1 and 2 are perspective views of a roll bag with handle elements unassembled and assembled, respectively.
Figure 2:
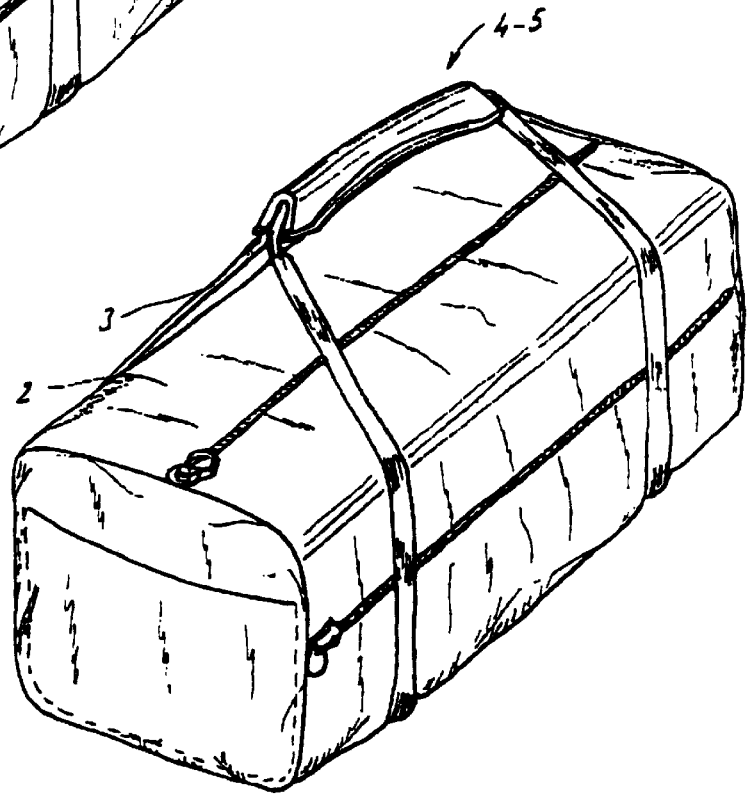

As shown in FIGS. 1 and 2, numerical reference 2 designates a roll bag with two straps 3 which may form loops. According to the invention, each of the straps is equipped with a handle element; in this case respectively with a male handle element 4 and a female handle element 5. The two elements are fixed securely onto the corresponding straps 3, preferably by overmolding synthetic material onto the corresponding straps 3.

Figure 3:
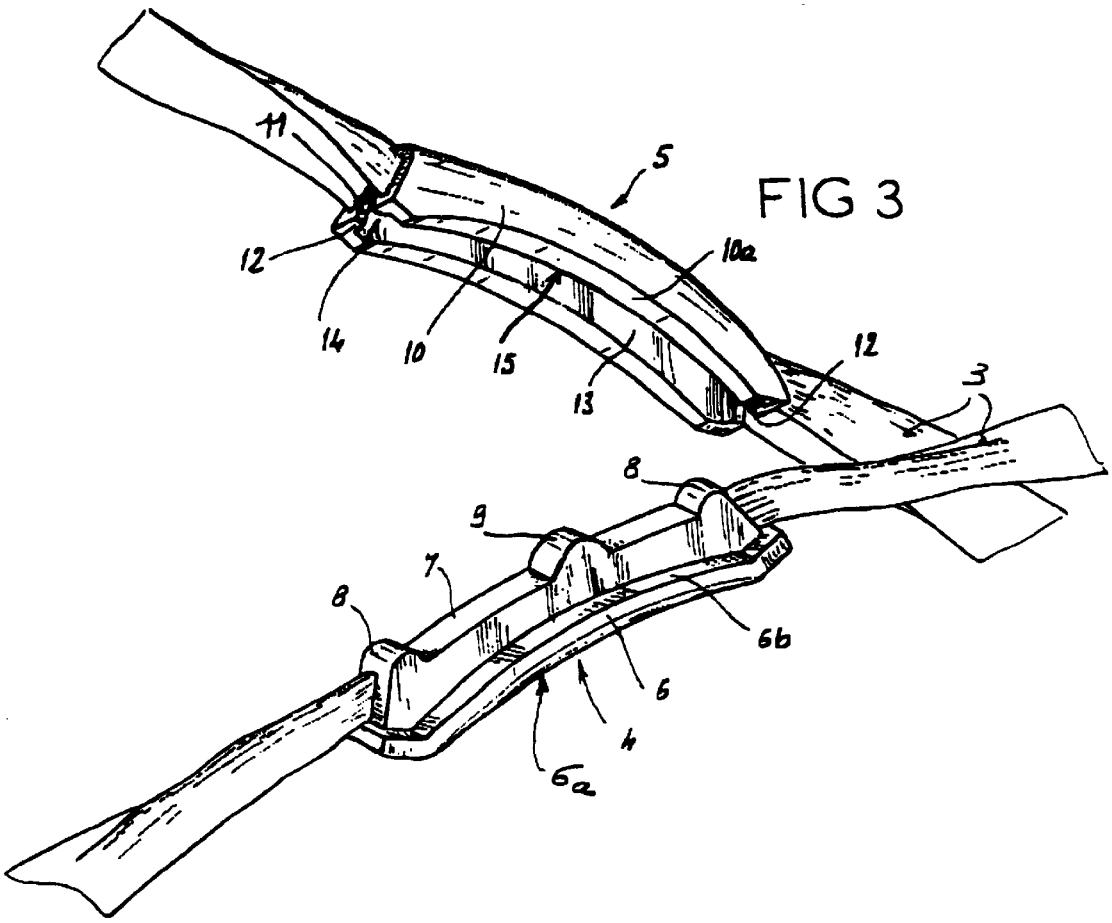
FIG. 3 is a partial perspective view showing two handle elements before they are assembled, according to the invention.

As shown in greater detail in FIG. 3, male element 4 may be made of a synthetic material with a lower Shore hardness and a higher coefficient of friction than the female handle element 5. For example, the Shore hardness of male element 4 may be between 40 and 90 Shore while that of female element 5 may be greater than 90 Shore. The male element 4 has the general shape of an inverted "T" in cross section, composed of a sole 6 and a lengthwise rib 7.

In the embodiment shown, lower face 5*a* of sole 6 is longitudinally concave and transversely convex in order to match the shape of the inside of the hand. Rib 7, in the example shown, has parallel lengthwise faces and pyramidal lugs, namely end lugs 8 and a center lug 9. These lugs serve as transverse and lengthwise positioning elements when the male element is joined to the female element. The end lugs 8 preferably project further from the sole 6 than the center lug 9.

In variants not shown, the male element can have only a single central pyramidal lug 9, or only two end lugs 8, or other configurations.

Female element 5 has the general shape of an inverted "U" in cross section, namely it has two lengthwise walls 10 and preferably also two end transverse walls 12 delimiting a cavity 13 that has the same shape as lengthwise rib 7. Walls 12, if present, are preferably slotted at 11 to allow strap 3 of the other element to pass through. End cavities 14 and a center cavity 15, which have complementary shapes to the shapes of the pyramidal lugs 8 and 9 that they are to receive, may be provided in cavity 13.

In the embodiment shown, each of the side members 10 of female element 5 has a concave lower edge 10*a* matching the convex upper face 6*b* of sole 6 of the male element 4.

The cavities 13, 14, 15 are preferably slightly smaller than rib 7 and lugs 8, 9, so that they can be force-fitted, or press-fitted, onto the rib 7 and lugs 8, 9 when the male element 4 is joined to the female element 5 to form a compact handle.

When this force-fitting takes place, end lugs 8, which are taller, first come in contact with sloping faces of cavities 14 to pre-position male element 4 with respect to female element 5. When the lugs have completed the positioning of male element 4 with respect to female element 5, and vice versa, the joining of the two elements is improved by bringing them together to the point that edges 10*a* contact convex face 6*b* of male element 4.

Figure 4:
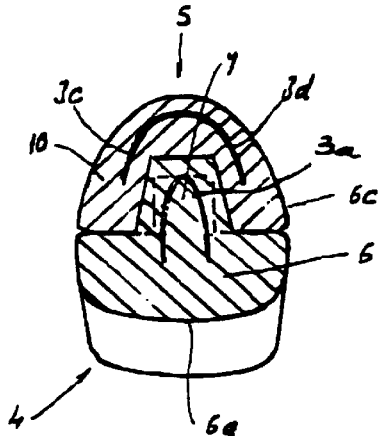
FIG. 4 is a side view in cross section showing two handles assembled, according to the invention.

FIG. 4 shows that the overmolded part of the strap of male element 4, in the overmolding area, may be folded into the shape of an inverted "U" so that its core 3*a* is inserted into lengthwise rib 7 while the strap on which female element 5 is overmolded may be folded into the shape of an inverted "U" so that its two side members 3*c*, 3*d* are embedded in walls 10 that border center cavity 13 of the element. This being the case, straps 3, which are preferably made of a synthetic fiber weave but may be made of other materials, undergo no creasing which might damage them and they reinforce each of the overmolded elements with respect to each other. Moreover, as shown in FIG. 3, when these elements emerge, they have no creases which could damage them when the handle is manipulated.

Figure 5:
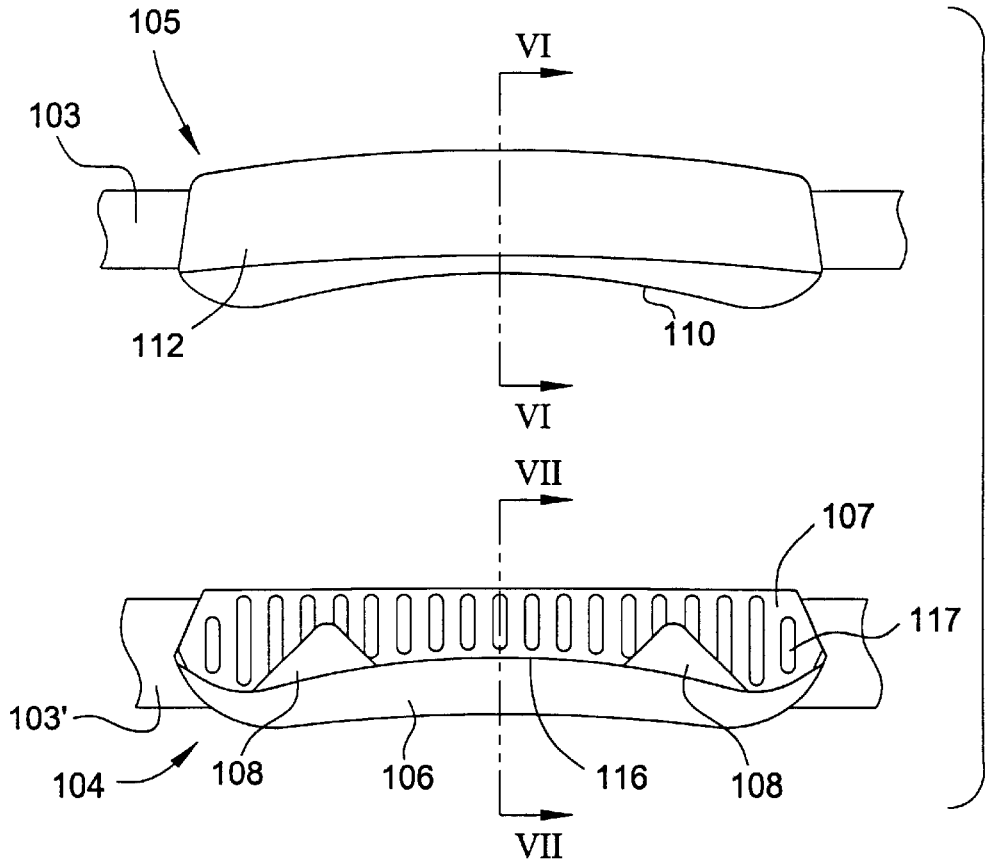
FIG. 5 is a side view of male and female handle elements, unassembled, according to an embodiment of the invention.
Figure 6:
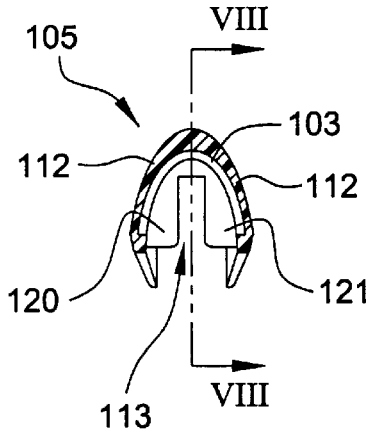
FIG. 6 is a cross-sectional view along sectional line VI—VI of the female element, according to an embodiment of the invention.
Figure 7:
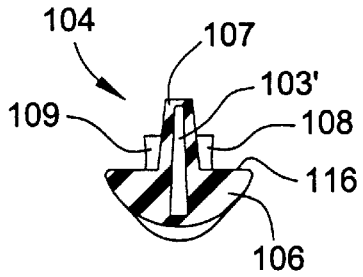
FIG. 7 is a cross-sectional view along sectional line VII—VII of the male element, according to an embodiment of the invention.
Figure 8:
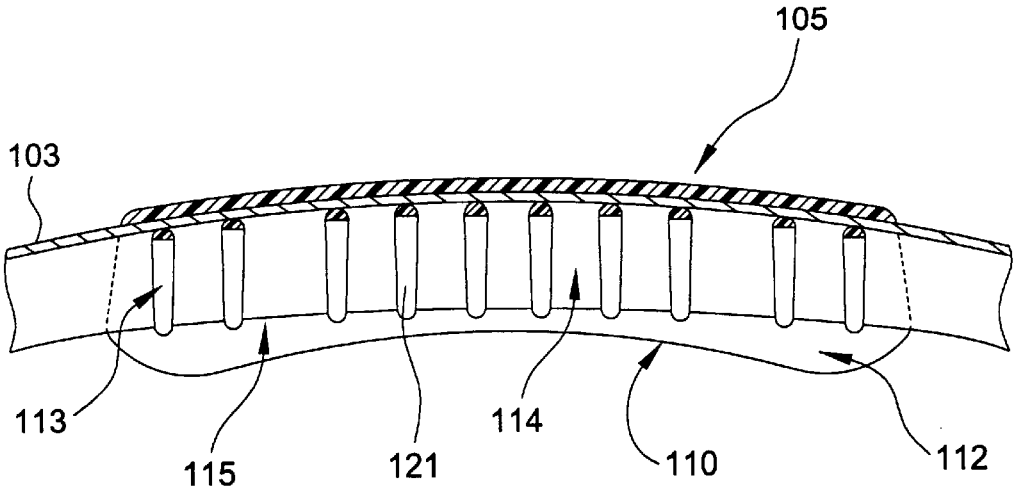
FIG. 8 is a lengthwise cross-sectional view along sectional line VIII—VIII of the female element, according to an embodiment of the invention.

FIG. 5 illustrates another embodiment of the present invention. As shown in FIG. 5, the assemblable handle has a male element 104 and a female element 105. The male element 104 has the general shape of an inverted "T" in cross section, including a sole 106 and a lengthwise rib 107. The lengthwise rib 107 receives a strap 103'. The lengthwise rib 107 has a plurality of elongated throughholes 117 formed therein, thus allowing the lengthwise rib 107 to more readily elastically deform when mated with the female element 105.

The lengthwise rib 107 of this embodiment also includes a pair of pyramidal lugs 108, 109 protruding outward from each side of the lengthwise rib 107. The lugs serve as transverse and lengthwise positioning elements when the male element is joined to the female element 105. The male element can have only a single central pyramidal lug or any desired number of lugs.

Female element 105 has the general shape of an inverted "U" in cross section; namely it has two lengthwise walls 112 with a shape complementary to that of the lengthwise rib 107. The walls 112 can include projections 120, 121 spaced from the walls 112 to receive a strap 103. The projections 120, 121 extend inwardly from each of the walls 112 and delimit a cavity 113 for receiving the lengthwise rib 107 of the male element 104. Spaces 114 are provided between adjacent projections in a lengthwise direction, and alignment spaces 115 may be dimensioned to receive the pyramidal lugs 108.

In the embodiment shown, each of the walls 112 of the female element 105 has a concave lower edge 110 matching the convex upper face 116 of the sole 106 of the male element 104.

The cavity 113 is preferably slightly narrower than the rib 107 so that the female element 105 can be force-fitted onto the rib 107 when the male element 104 is joined to the female element 105 to form a compact handle.

When this force-fitting takes place, the lugs 108, 109 can first come in contact with the projections forming the alignment spaces 115 to pre-position the male element 104 with respect to the female element 105. When the lugs 108, 109 have completed the positioning of the male element 104 with respect to female element 105, and vice versa, the joining of the two elements is improved by bringing them together to the point that edges 110 of the female element contact the convex face 116 of the male element 104.

FIG. 2 shows that, when the two elements are assembled, the handle forms a one-piece assembly that can be readily gripped, facilitating the lifting of a heavily loaded bag 2.

These same handle elements can be used when the bag is carried between two people, in which case, as shown in FIG. 1, concave edges 10*a* of female element 5 assist gripping without hurting the hand.

It emerges from the foregoing that the assembled handle according to the invention improves bag carrying comfort by means that exert no additional stress on the straps 3 from which the loops are formed.

It is evident that this type of handle can be used on any type of double strap bag, and generally on any package.

What is claimed is:

1. An assemblable handle for a double strap bag, comprising two elements made of synthetic material, each element connected to a strap, the elements including a male element having a generally inverted T-shaped cross section comprising a sole and a lengthwise rib and a female element having a generally inverted U-shaped cross section with an inside cavity capable of fitting elastically onto the lengthwise rib of the male element.

2. The handle according to claim 1, wherein the male element is made of a synthetic material differing from that of which the female element is made by a lower Shore hardness and a higher coefficient of friction.

3. The handle according to claim 1, further comprising at least one lug projecting from a face of the lengthwise rib of the male element, the lug forming a transverse and lengthwise positioning element of the male element relative to the female element by cooperating with at least one corresponding cavity of complementary shape provided in the female element.

4. The handle according to claim 3, wherein the at least one lug is pyramidal in shape.

5. The handle according to claim 3, wherein the male element has at least two lugs disposed at the ends of the lengthwise rib.

6. The handle according to claim 3, wherein a lug is disposed half way along the lengthwise rib of the male element.

7. The handle according to claim 3, wherein the male element has two end lugs and one center lug, the end lugs forming taller projections than the center lug.

8. The handle according to claim 1, wherein, in the male element, the strap is folded into a generally inverted U-shape with a core within the lengthwise rib, and wherein, in the female element, the strap is folded into a generally inverted U-shape having two side members within walls defining the inside cavity of the female element.

9. The handle according to claim 1, wherein a lower face of the sole of the male element is concave longitudinally and convex transversely.

10. The handle according to claim 1, wherein edges of side walls of the female element are concave, and an upper face of the sole of the male element has a matching convex shape.

11. The handle according to claim 1, further comprising at least one lug protruding outward from each side of the lengthwise rib of the male element, each said lug forming a transverse and lengthwise positioning element of the male element relative to the female element by cooperating with at least one corresponding space of matching dimension provided in the female element.

12. The handle according to claim 11, wherein the at least one lug is pyramidal in shape.

13. The handle according to claim 1, wherein the lengthwise rib includes a plurality of elongated throughholes.

14. The handle according to claim 13, wherein the lengthwise rib is elastically deformable when mated with the female element.

15. The handle according to claim 1, wherein the female element includes two side walls, each side wall having inwardly extending projection that form the inside cavity.

16. The handle according to claim 1, wherein the inside cavity is slightly narrower than the width of the lengthwise rib, and wherein the male element and the female element are capable of being connected with a force-fit relationship.

17. The handle according to claim 1, wherein each of said handle elements is overmolded on a respective one of the straps.

18. A bag comprising:

two straps, each said strap having two ends, each said end connected to the bag; and two handle elements, each handle element connected to one of said straps, the elements including a male element having a generally inverted T-shaped cross section comprising a sole and a lengthwise rib and a female element having a generally inverted U-shaped cross section with an inside cavity capable of fitting elastically onto the lengthwise rib of the male element.

19. The bag according to claim 18, wherein when the handle elements are assembled, an exposed side of the sole opposite to the lengthwise rib faces the bag.

20. The bag according to claim 19, wherein when the assembled handles are grasped, a force provided to the sole operates to maintain the handle elements in the assembled relationship.

* * * * *